US010037879B2

(12) United States Patent
Taniguchi

(10) Patent No.: US 10,037,879 B2
(45) Date of Patent: Jul. 31, 2018

(54) ION TRAP DESIGN METHOD AND ION TRAP MASS SPECTROMETER

(71) Applicant: SHIMADZU CORPORATION, Kyoto-shi, Kyoto (JP)

(72) Inventor: Junichi Taniguchi, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/435,462

(22) Filed: Feb. 17, 2017

(65) Prior Publication Data

US 2017/0301532 A1 Oct. 19, 2017

(30) Foreign Application Priority Data

Apr. 13, 2016 (JP) ..... 2016-080038

(51) Int. Cl.
*H01J 49/42* (2006.01)

(52) U.S. Cl.
CPC ..... *H01J 49/4225* (2013.01); *H01J 49/424* (2013.01)

(58) Field of Classification Search
CPC ..... H01J 49/42; H01J 49/4225; H01J 49/423; H01J 49/424; H01J 49/4255
See application file for complete search history.

(56) References Cited

U.S. PATENT DOCUMENTS

| | | | | |
|---|---|---|---|---|
| 8,415,617 B2 * | 4/2013 | Schwartz | ..... | H01J 49/423 250/281 |
| 2004/0051036 A1 * | 3/2004 | Franzen | ..... | H01J 49/4225 250/282 |
| 2004/0108456 A1 * | 6/2004 | Sudakov | ..... | H01J 49/4215 250/288 |
| 2008/0217527 A1 | 9/2008 | Wang | | |

FOREIGN PATENT DOCUMENTS

| | | |
|---|---|---|
| JP | 2003-234082 A | 8/2003 |
| JP | 2006-524413 A | 10/2006 |
| JP | 2007-080830 A | 3/2007 |
| JP | 2010-520605 A | 6/2010 |

OTHER PUBLICATIONS

Y. Wang et al., "The non-linear ion trap. Part 3. Multipole components in three types of practical ion trap," International Journal of Mass Spectrometry and Ion Processes, 1994, pp. 155-172, vol. 132.
L.D. Landau et al., "Mechanics," Pergamon Press, 1969, 176 pages, vol. 1, Second Edition.

* cited by examiner

*Primary Examiner* — David E Smith
(74) *Attorney, Agent, or Firm* — Sughrue Mion, PLLC

(57) ABSTRACT

In a three-dimensional quadrupole-type ion trap, a shape and an arrangement of the ring electrode and the end cap electrodes 11 and 12 are shifted from an ideal state in which only a quadrupole electric field is formed, so that the polarities of the ratio of strength of an octupole electric field with respect to the strength of a quadrupole electric field and (Continued)

the ratio of strength of a dodecapole electric field with respect to the strength of the quadrupole electric field are different from each other, their absolute values are equal to or greater than 0.02, and the absolute value of the ratio of strength of the octupole electric field with respect to the strength of the dodecapole electric field is within the range of from 0.6 to 1.4.

3 Claims, 10 Drawing Sheets

| TYPE | [A] | [B] | [C] | [D] | [E] | [F] |
|---|---|---|---|---|---|---|
| A4 / A2 (%) | 5.34 | 3.92 | 3.54 | 3.26 | 2.374 | 2.071 |
| A6 / A2 (%) | -0.33 | -2.22 | -2.54 | -2.5 | -2.399 | -2.37 |
| A4 / A6 | -16.1818 | -1.78378 | -1.3937 | -1.304 | -0.98958 | -0.87384 |

ION TRAP DESIGN METHOD AND ION TRAP MASS SPECTROMETER

TECHNICAL FIELD

The present invention relates to a method of designing an ion trap for capturing ions by the action of high-frequency electric field and to an ion trap mass spectrometer equipped with the ion trap.

PRIOR ART

In a mass spectrometer, an ion trap is used to capture and trap ions by the action of high-frequency electric field, to sort out ions having a specific mass-to-charge ratio m/z or range of mass-to-charge ratio, and to further cleave the selected ions by means of collision-induced dissociation (CID).

FIG. 13 at (a) is a cross sectional view illustrating a basic configuration of a three-dimensional quadrupole-type ion trap, which is a typical ion trap. This ion trap 1 comprises one ring electrode 10 having a rotating one-leaf hyperboloid shape in which the inner surface rotates centering on r-axis, and a pair of end cap electrodes 11 and 12 sandwiching this ring electrode 10 and having a rotating two-leaf hyperboloid shape in which the inner surface rotates centering on z-axis arranged facing one another. In general, when capturing ions in a space surrounded by the ring electrode 10 and the end cap electrodes 11 and 12, high-frequency voltage $V\cos \Omega t$ of high voltage is applied to the ring electrode 10.

Other than the three-dimensional quadrupole-type ion trap, a linear-type ion trap comprising four rod-shape electrodes arranged in parallel with one another and a pair of electrodes arranged on the outer side of both ends is also known. In this specification, for the sake of convenience, an example of a "three-dimensional quadrupole-type ion trap" will be made, and this will simply be referred to as "the ion trap," however, as will be mentioned later, the present invention is also applicable to linear-type ion traps.

Theoretical analysis has been explained in details in the past with regard to the high-frequency electric field formed inside the ion trap 1 and the mass-to-charge ratio of ions captured by such electric field (refer to Non-Patent Literature 1).

In an ideal or theoretical ion trap, as has been described above, the inner surfaces of the ring electrode 10 and the end cap electrodes 11 and 12 are in a rotating hyperboloid shape, and the inscribed radius $r_0$ of the ring electrode 10 and the distance $z_0$ between the central point of the ion trap 1 and the top of the end cap electrodes 11 and 12 are in the relationship as defined the following equation (1).

$$r_0^2=2z_0^2 \quad (1)$$

Furthermore, as shown in FIG. 13 at (a), the asymptote of the hyperboloid of the inner surface of the ring electrode 10 and the hyperboloid of the inner surface of the end cap electrodes 11 and 12 are the same (match).

As has been described above, when the shape and the arrangement of each electrode that constitutes the ion trap are set according to the theory, the high-frequency electric field formed inside the ion trap is a quadrupole electric field only. On the contrary, a configuration devised so as to intentionally distort an ion trap from a theoretical shape has often been adopted conventionally, by shifting the end cap electrodes 11 and 12 along z-axis so as to separate the electrodes from each other in order to enlarge the distant $z_0$ between the central point of the ion trap and the top of the end cap electrodes 11 and 12 (refer to the white arrow in FIG. 13 at (b)), or by changing the slope of a straight line to be closer to the rotating hyperboloid of the electrodes 10, 11, and 12 (refer to Patent Literatures 1-3 and Non-Patent Literature 1). As such, when the shape or the arrangement of the ion trap are shifted from the theoretical states, in addition to the quadrupole electric field, a multipole electric field of order higher than quadrupole (hereinafter, those of order higher than quadrupole will be referred to as "multipole") occurs.

For example, when an octupole electric field is added to a quadrupole electric field, compared to the case of a quadrupole electric field only, the discharge of ions from an ion trap is rapidly carried out in a certain voltage when the voltage applied to the ion trap is scanned as the ions are being trapped by the ion trap. By using this phenomenon, it is possible to improve the mass resolution in the ion trap mass spectrometer. Furthermore, it is possible to improve the capture efficiency of ions inside the ion trap by the octupole electric field, thereby also improving the detection sensitivity. Conventional ion traps commercially available considerably adopt a configuration that utilizes a multipole electric field as described above in order to obtain such effect.

PRIOR ART LITERATURE

Patent Literatures (Patent Literature 1) Japanese Unexamined Patent Application Publication 2003-234082 (paragraph (0012)-(0013))

(Patent Literature 2) Japanese Examined Patent Application Publication 2006-524413

(Patent Literature 3) Japanese Examined Patent Application Publication 2010-520605

(Patent Literature 4) Japanese Unexamined Patent Application Publication 2007-80830 (paragraph (0042)-(0043), and FIG. 8-FIG. 10)

Non-Patent Literature (Non-Patent Literature 1) Y. Wang, and one other author, "The non-linear ion trap. Part 3. Multipole components in three types of practical ion trap," International Journal of Mass Spectrometry and Ion Processes, Vol. 132, 1994, pp. 155-172

(Non-Patent Literature 2) L.D. Landau, and one other author, "Mechanics," Pergamon Press, 1969.

SUMMARY OF THE INVENTION

Problem to be Solved by the Invention

When $MS^n$ analysis (n is an integer of 2 or greater) is carried out in an ion trap mass spectrometer, after ions originating from a target sample are trapped in an ion trap, a precursor selection for discharging unnecessary ions having other than the targeted mass-to-charge ratio is performed inside the ion trap, and ions having the targeted mass-to-charge ratio remaining in the ion trap need to be separated by means of collision-induced dissociation (CID). A technique of applying a signal having a frequency spectrum of bandwidth having a notch to the frequency corresponding to the targeted mass-to-charge ratio, that is an FNF (=Filtered Noise Field) signal, to the end cap electrodes is widely used as the precursor selection operation.

The ion capture efficiency can be improved by the generation of a multipole electric field by intentionally distorting the electrode shape and arrangement of the ion trap described above; however, if the shift from the ideal state become larger than a certain degree, the resolution of ion isolation during the precursor selection decreases even if the ion capture efficiency improves, which is a problem. If the resolution of an ion isolation decreases, the product ion peak originating from undesired ions other than the targeted ions appears in the $MS^n$ spectra, leading to a decrease in the quality of the $MS^n$ spectra. Based on such restriction, conventionally, in the case of ion trap mass spectrometer for carrying out $MS^n$ analysis, the shift from the ideal states of the electrode shape and arrangement of the ion trap has been suppressed to an appropriate range determined from the experience. That is, conventional ion trap mass spectrometers do not necessarily have optimized designs such as high resolution of ion isolation and making the ion capture efficiency as high as possible. Therefore, either the resolution of the ion isolation or the ion capture efficiency has to be sacrificed.

The present invention was made to solve the problems described above and is to provide a method of designing an ion trap that can create $MS^n$ spectra of high quality and improve the detection sensitivity by securing high resolution of ion isolation and also achieving high ion capture efficiency, and to provide an ion trap mass spectrometer using the ion trap designed by the design method described above.

Means for Solving the Problem

The resolution of ion isolation for ions captured in an ion trap by a high-frequency electric field corresponds to the shape of the resonance curve that shows the relationship between the forced oscillation frequency of ions in a high-frequency electric field and the vibration amplitude of the ions. As has been well known, when the high-frequency electric field formed by the ion trap is a quadrupole electric field only, that is, when it is in an ideal state, the shape of the resonance curve typically becomes a symmetric mountain peak as shown in FIG. 5 at (a). On the contrary, as disclosed in Patent Literature 4, when an octupole electric field is added to a quadrupole electric field, the shape of the resonance curve becomes asymmetrical as shown in FIG. 5 at (b), with the slope of the peak on the low-frequency side or the high-frequency side becoming steep. Such steep slope means that the state of resonance is sharp, indicative of high resonance resolution, i.e., high resolution of the ion isolation.

However, as in the case shown by the example disclosed in Patent Literature 4, when the slope on one side of the peak becomes steep, the slope of the other side becomes gently in reverse, so when one wants to selectively retain ions with a specific mass-to-charge ratio or range of mass-to-charge ratio in an ion trap, the resolution on the side where the slope is gentle, i.e., on the side with low mass-to-charge ratio or high mass-to-charge ratio, becomes poor, causing the ions with a mass-to-charge ratio wider than a desired mass-to-charge ratio or range of mass-to-charge ratio to remain in the ion trap.

In response to this, the present inventor obtained the strength and the resonance curve of a multipole electric field when the shape and the arrangement of electrodes of the ion trap were changed into various shapes and arrangements using a simulation calculation, and as a result, found that the slope on both sides of the resonance curve became comparatively steep when a dodecapole electric field of high order was further superimposed on an octupole electric field superimposed on a quadrupole electric field, the polarities of the octupole electric field and the dodecapole electric field were in reverse, the ratio of strength between the octupole electric field and the dodecapole electric field with respect to the quadrupole electric field was about the same, and certain conditions were met. In other words, as long as the shape and the arrangement of electrodes are shifted from an ideal state so that the strengths of the octupole electric field and the dodecapole electric field superimposed on the quadrupole electric field fulfill a certain condition, it is possible to retain high ion capture efficiency and increase the resolution of ion isolation. Thus, the present invention was completed based on such findings.

That is, a method of designing an ion trap according to the present invention devised in order to solve the problems described above is a method of designing an ion trap for capturing ions in a space by forming a quadrupole electric field and a multipole electric field of order higher than that [of the quadrupole electric field] in a space surrounded by three or more electrodes by the voltage applied to each of these electrodes and for carrying out ion isolation in which, among the ions captured, ions having a specific mass-to-charge ratio or contained in a specific range of mass-to-charge ratio are retained, and ions other than that are discharged, characterized in that the shape and the arrangement of equal to or greater than three electrodes described above are determined so that the polarities of the ratio of strength of an octupole electric field with respect to the strength of a quadrupole electric field and the ratio of strength of a dodecapole electric field with respect to the strength of the quadrupole electric field are different from each other, their absolute values are equal to or greater than 0.02, respectively, and the absolute value of the ratio of the strength of the octupole electric field with respect to the strength of the dodecapole electric field is in the range of 0.6-1.4.

The ion trap mass spectrometer according to the present invention made for solving the problem described above is an ion trap mass spectrometer for capturing ions in an ion trap and then performing ion isolation to these captured ions by allowing ions having a specific mass-to-charge ratio or contained within a specific range of mass-to-charge ratio to remain and excluding other ions, wherein this ion trap mass spectrometer is equipped with an ion source for generating ions originating from a sample, an ion trap comprising equal to or greater than three electrodes for capturing ions in a space by forming a quadrupole electric field and a multipole electric field of order higher than that [of the quadrupole electric field] in a space surrounded by these electrodes by a voltage applied to each electrode, and an ion detector for detecting ions discharged from the ion trap; characterized in that the aforementioned ion trap is devised to determine the shape and the arrangement of equal to or greater than three electrodes so that the polarities of the ratio of strength of an octupole electric field with respect to the strength of a quadrupole electric field and the ratio of strength of a dodecapole electric field with respect to the strength of the quadrupole electric field are different from each other, their absolute values are equal to or greater than 0.02, respectively, and the absolute value of the ratio of the strength of the octupole electric field with respect to the strength of the dodecapole electric field is in the range of 0.6-1.4.

The ion trap according to the present invention is a three-dimensional quadrupole-type ion trap or a linear-type ion trap. In the case of the three-dimensional quadrupole-type ion trap, the three electrodes described above are one ring electrode and two end cap electrodes arranged facing one another. In the case of the linear-type ion trap, the three or more electrodes described above are four rod-like electrodes arranged in parallel with each other so as to surround a central axis.

For example, when the ion trap according to the present invention is a three-dimensional quadrupole-type ion trap, as has been described above, the ideal shape and the arrangement of the ring electrode and the end cap electrodes are well known. In order to add an octupole electric field and a dodecapole electric field to a quadrupole electric field as described above, for example, several techniques can be considered: that is, a technique of reducing the inner diameter of a ring electrode than that of an ideal state while keeping the shape of each electrode in an ideal state, a technique of allowing a pair of end cap electrodes to be close to a central point (i.e., to be symmetrical) while keeping the shape of each electrode in an ideal state, or a technique of changing the inner shape on the top side to be in a conical shape instead of hyperboloid, rather than the prescribed surface perpendicular to the rotation axis of the pair of the end cap electrodes.

Effect of the Invention

According to the method of designing an ion trap and the ion trap mass spectrometer according to the present invention, it is possible to increase the resolution of ion isolation for the precursor ion selection, for example, while maintaining high ion capture efficiency. Thereby, it is possible to allow ions with high purity having the target mass-to-charge ratio to remain in an ion trap, and it is possible to obtain the MS″ spectra of excellent quality originating from the target ions. In addition, it is also possible to realize high detection sensitivity.

DETAILED DESCRIPTION OF THE EXEMPLARY EMBODIMENTS

Figure 1:
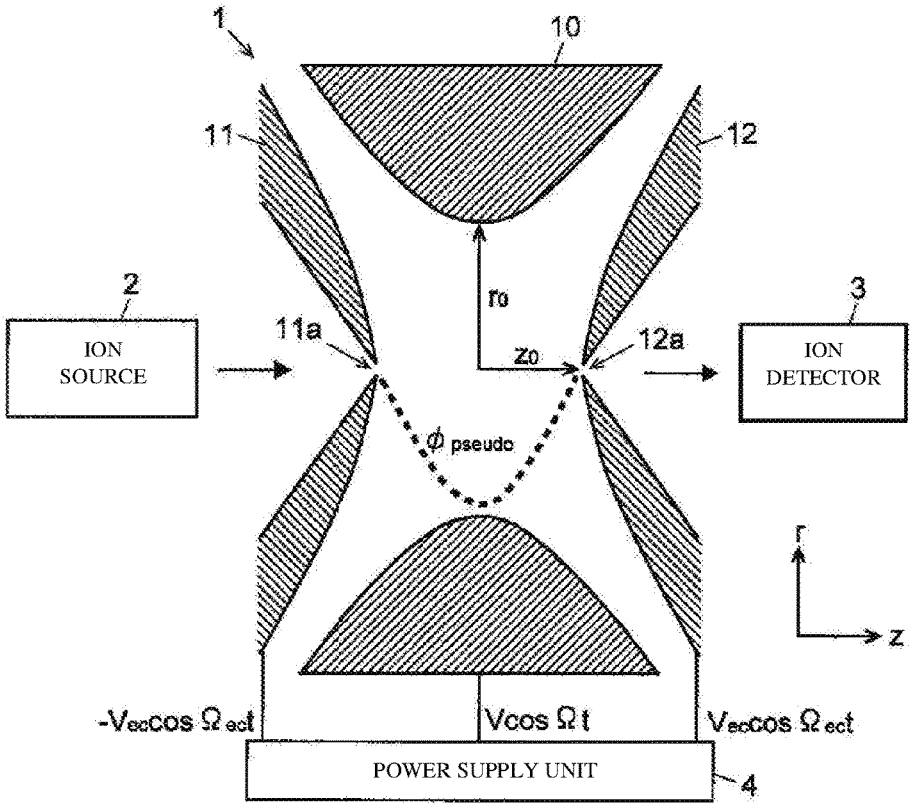
FIG. 1 is a schematic configuration drawing of an ion trap mass spectrometer according to one example of embodiment of the present invention.

One example of embodiment of the method of designing an ion trap and the ion trap mass spectrometer using the ion trap designed by the method according to the present invention will be described with reference to the accompanying drawings. FIG. 1 is a schematic configuration diagram of the ion trap mass spectrometer of the present example of embodiment.

The ion trap mass spectrometer according to the present example of embodiment is equipped with an ion source 2 for ionizing a target sample, an ion trap 1, which is of a three-dimensional quadrupole type, and an ion detector 3 for detecting ions discharged from the ion trap 1, and all of these are housed inside a vacuum chamber, not shown in the drawing.

The ion trap 1 comprises one ring electrode 10, an inlet-side end cap electrode 11 and an outlet-side end cap electrode 12 arranged facing one another so as to hold this [ring electrode] in between, and the space surrounded by these three electrodes 10, 11, and 12 becomes the ion capture area. On one hand, an ion incident aperture Ila is drilled nearly in the center of the inlet-side end cap electrode 11, and the ion exiting from the ion source 2 is introduced into the ion trap 1 through this ion incident aperture 11*a*. On the other hand, an ion exit aperture 12*a* is drilled nearly in the center of the outlet-side end cap electrode 12, the ion detector 3 is arranged on the outer side of this ion exit aperture 12*a* to detect the ions discharged passing through the ion exit aperture 12*a*.

A power supply unit 4 is used for applying a predetermined sinusoidal voltage to each of the electrodes 10, 11, 12 that constitute the ion trap 1. To be specific, the power supply unit 4 applies a sinusoidal voltage of Vcos Ωt to the ring electrode 10 for capturing ions in a capture area. That frequency Ω is adjusted depending on the range of mass-to-charge ratio of the ions captured. Meanwhile, the power supply unit 4 applies high-frequency voltage±Vec cos Ωec t of reversed polarity to both end cap electrodes 11 and 12 for eliminating unnecessary ions among the ions captured in the capture area or for discharging and detecting ions captured through the ion exit aperture 12*a*. The applicable ions are resonated by matching the frequency Ωec of applied voltage to these end cap electrodes 11 and 12 with the oscillation frequency of ions, making it possible to carry out ion isolation and discharge.

An ideal ion trap as described above has the ring electrode 10 and the end cap electrodes 11 and 12 having their inner surface in a rotating hyperboloid shape, and the distance $z_0$ between the top of the end cap electrodes 11 and 12 and the center point of the ion trap 1 and the inscribed radius $r_0$ of the ring electrode 10 fulfill the equation (1) above.

In the ion trap 1 as shown in FIG. 1, the potential distribution ϕ inside the surface including an ion optical axis (z-axis in this example) in an axisymmetric field can generally be realized by the following equation (2).

$$\phi(\rho, \theta)=V\Sigma A_n(\rho/z_0)^n P_n(\cos\theta) \quad (2)$$

Σ here is the total sum from n=0 until ∞. Furthermore, ρ is the distant from the origin (the center point of the ion trap 1) until the observation point, $\rho=\sqrt{(r^2+z^2)}$, θ is the angle from z-axis of the observation point centering on the origin, V is an applied voltage, $A_n$ is a multipole electric field coefficient, $A_2$ is a quadrupole, $A_3$ is a hexapole, $A_4$ is an octupole, $A_5$ is a decapole, and $A_6$ is a dodecapole. When the shape and the arrangement of the electrodes 10, 11, and 12 are axisymmetric surrounding the r-axis and z-axis, the top in which n is an odd number does not exist, only the top in which n is an even number exits. Distant $z_0$ is used as a normalization constant. Pn is a Legendre polynomial.

In principle, a quadrupole field is dominant for the ion trap 1, and the potential distribution of the quadrupole field is expressed by the following equation (3).

$$\phi=(V/z_0^2)A_2(2z^2-r^2) \quad (3)$$

Although only this quadrupole field is the electric field formed in the ion trap of an ideal state, a multipole electric field of high order occurs when the shape and the arrangement of the electrodes are shifted from the ideal state. Here, the fact that the shape and the arrangement of the electrodes 10, 11, and 12 are axisymmetric surrounding the r-axis and z-axis is maintained, and odd higher-order terms are not taken into consideration. The potential distribution of the octupole electric field is expressed by the following equation (4).

$$\phi=VA_4[(8z^4-24z^2r^2+3r^4)/8z_0^4] \quad (4)$$

Furthermore, the potential distribution of the dodecapole electric field is expressed by the following equation (5).

$$\phi VA_6((16z^6-120z^4r^2+90z^2r^4-5r^6)/16z_0^6) \quad (5)$$

Now, the case of the existence where an octupole electric field superimposes a quadrupole electric field is considered. The potential distribution inside the ion trap 1 in such a case is expressed by the following equation (6).

$$\phi=(V/z_0^2)A_2(2z^2-r^2)+(V/8z_0^4)A_4(8z^4-24z^2r^2+3r^4) \quad (6)$$

In this case, the ion confining potential ϕeff is expressed by the following equation (7).

$$\phi\text{eff}=(eEz^2)/(4mQ^2)=((qA_2^2V)/(4z_0^2))z^2+((qA_2A_4V)/(z_0^4))z^4 \quad (7)$$

When ions are captured while being vibrated by this potential, such equation of motion is expressed by the following equation (8).

$$z+((eqA_2^2V)/(2z_0^2))z=-((4eqA_2A_4V)/(z_0^4))z^3 \quad (8)$$

Figure 5:
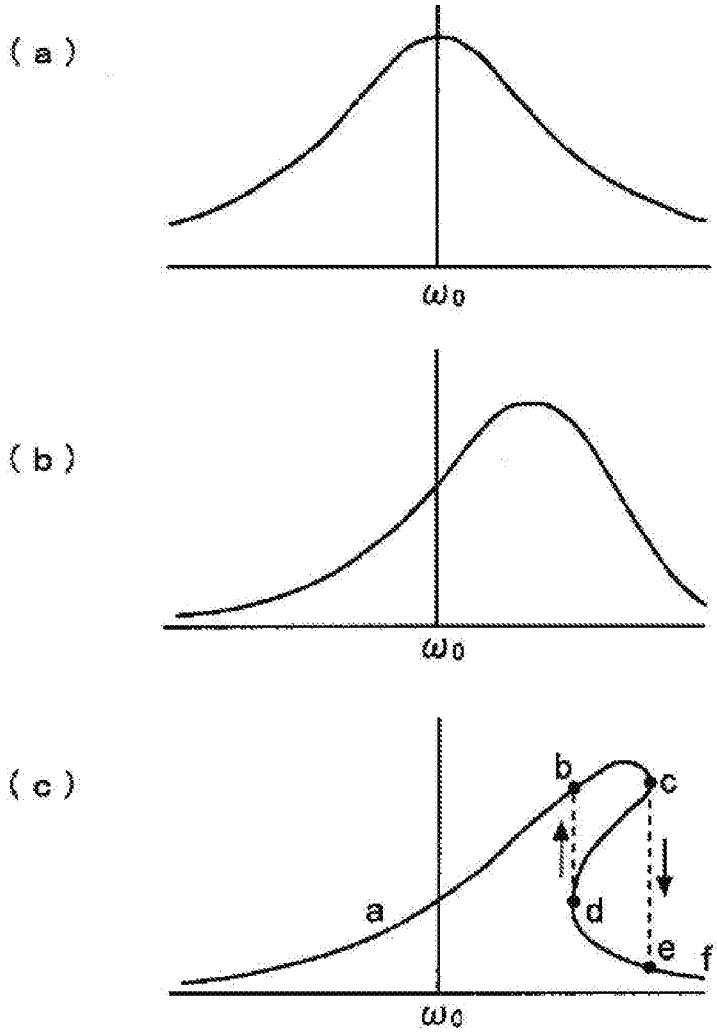
FIG. 5 is a drawing illustrating a resonance curve showing the relationship between the oscillation frequency and the vibration amplitude.

The term $z^3$ exists on the right side of equation (8). This is the equation of nonlinear oscillation called Duffing equation, and its solution is well known. When a forced oscillation by a forced oscillating electric field is added to the vibration based on such equation, the resonance curve that plots a vibration amplitude with respect to a forced oscillating frequency may be become the one as shown in FIG. 5 at (c) (refer to Non-Patent Literature 2). When the resonance curve is in the shape as shown in FIG. 5 at (c), for example, the amplitude increases according to slope f along with the change in the direction (the left direction along the horizontal axis in the drawing) in which the frequency becomes small, and the amplitude at the position of point d rapidly changes to point b. On the contrary, when it is with the change in the direction in which the frequency becomes large, the amplitude increase according to slope a along with that change, and the amplitude at the position of point c rapidly changes to point e Such discontinuous change is a jumping phenomenon, which will be explained later.

In the resonance curve as shown in FIG. 5, a deviation Aw of a resonance frequency is expressed by the following equation (9).

$$\Delta\omega=(A_4/A_2)\,(P^2/(z_0^2))\omega_0 \quad (9)$$

Where P is an amplitude value of the vibration. Equation (9) means that the resonance frequency shifts at a ratio of $A_4/A_2$ when the amplitude P is $z_0$.

Figure 2:
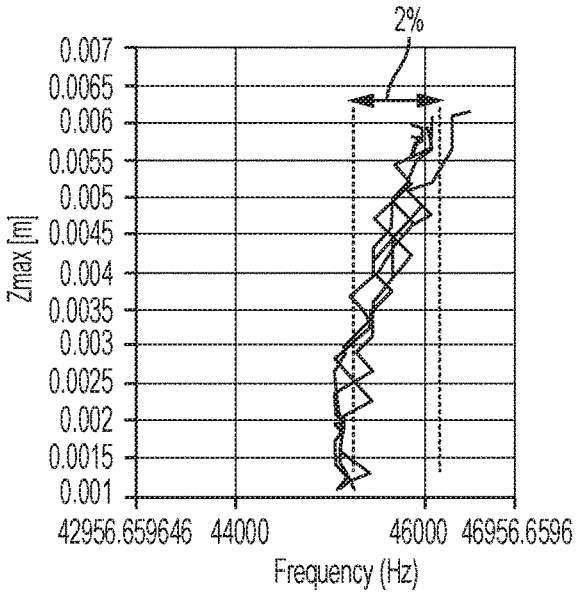
FIG. 2 is a drawing showing the results of simulating the relationship between the amplitude of ions and the oscillation frequency when a signal of resonance frequency at which an octupole electric field having 2% of a ratio of strength with respect to a quadrupole electric field is superposed is applied to the end cap electrodes.

FIG. 2 is a drawing showing the results of simulating the relationship between the amplitude of ions (vertical axis) and the oscillation frequency (horizontal axis) when a signal of resonance frequency at which an octupole electric field having 2% of a ratio of strength with respect to a quadrupole electric field is superposed is applied to the end cap electrodes 11 and 12. According to FIG. 2, the following result was obtained: as the amplitude increases, the resonance frequency shifts 2%.

Figure 4:
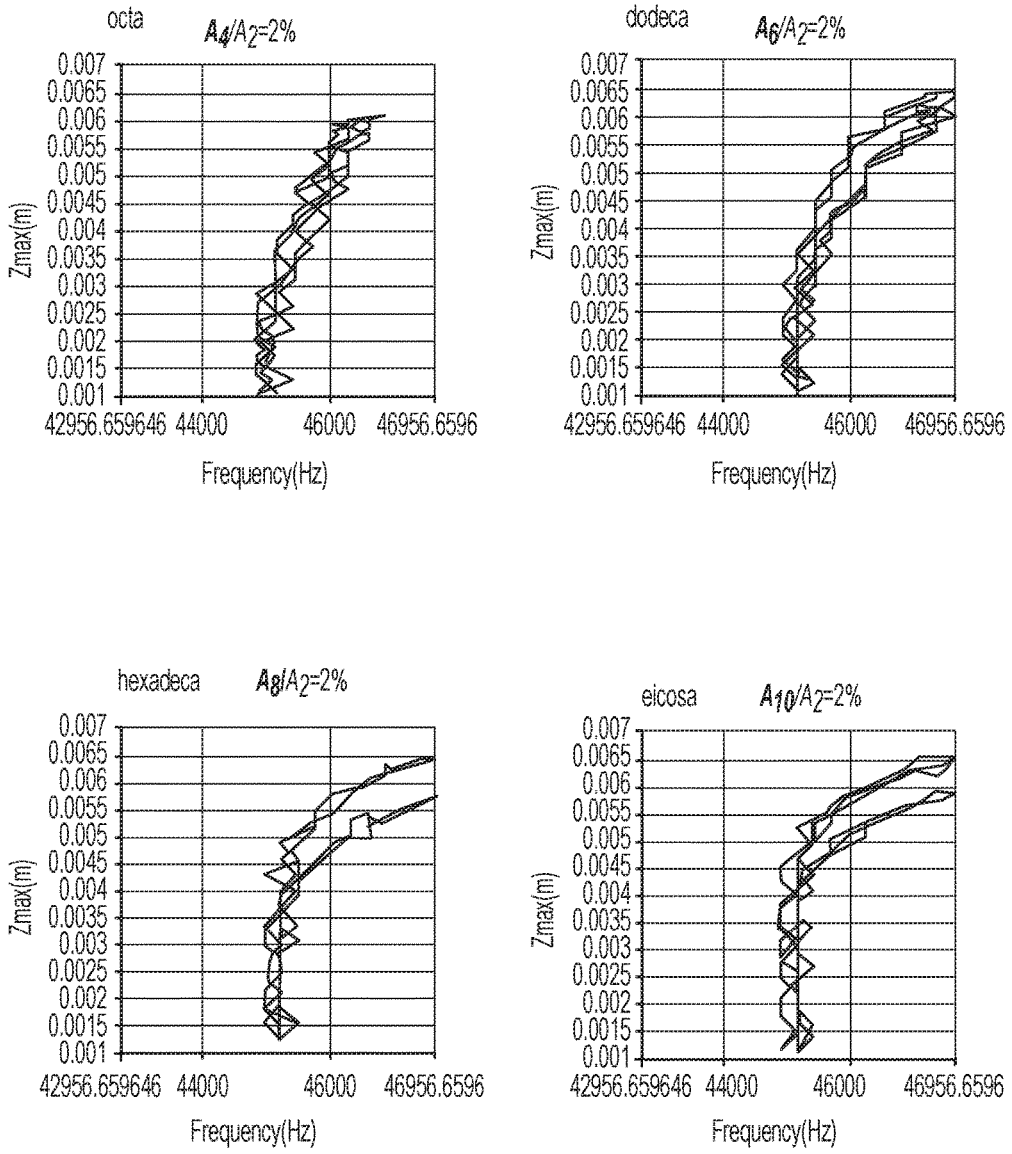
FIG. 4 is a drawing showing the results of simulating the relationship between the amplitude of ions and the oscillation frequency when a signal of the resonance frequency at which an octupole electric field, a dodecapole electric field, a hexadecapole electric field, and an icosapole electric field having 2% or −2% of a ratio of strength with respect to a quadrupole electric field are superposed is applied to the end cap electrodes.
Figure 4:
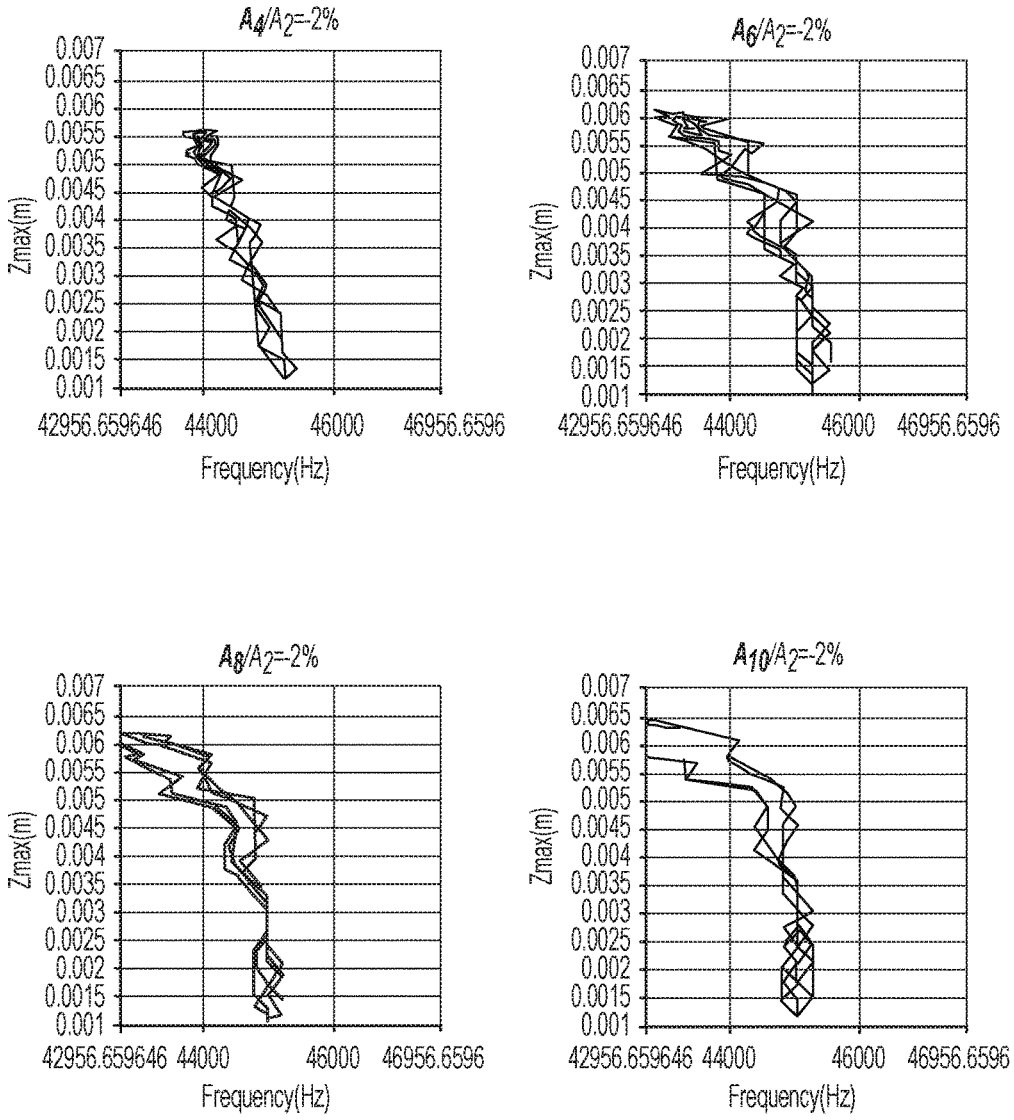

FIG. 4 is a drawing showing the results of simulating the relationship between the amplitude of ions and the oscillation frequency when a signal of a resonance frequency at which a dodecapole, a hexadecapole, an icosapole, and multipole electric fields of higher order are superposed is applied to the end cap electrodes 11 and 12. The ratio of strength of the multipole electric field with respect to the quadrupole electric field is +2% or −2%. As can be seen in FIG. 4, as the electric field becomes a higher order, the amplitude becomes large, initiating a deviation of the resonance frequency. In addition, it was also found that when the signs of the positive and negative electric fields superposed became in reverse, the deviation was observed in the direction where the resonance frequency became low.

Figure 3:
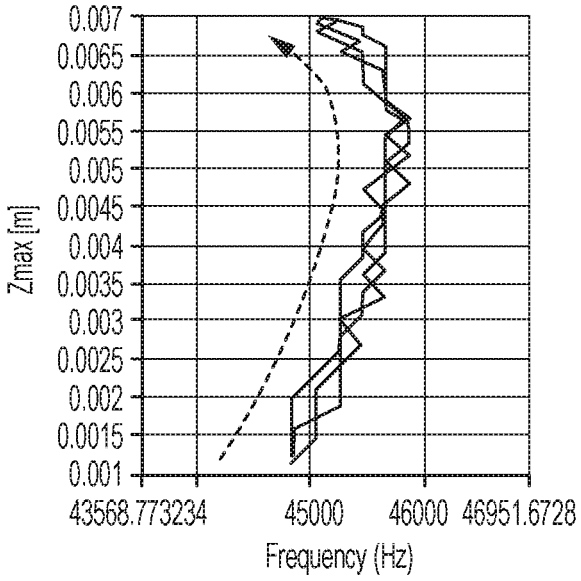
FIG. 3 is a drawing showing the results of simulating the relationship between the amplitude of ions and the oscillation frequency when a signal of the resonance frequency at which an octupole electric field having 4% of a ratio of strength with respect to a quadrupole electric field and a dodecapole electric field having −2% of a ratio of strength are superposed is applied to the end cap electrodes.

Next, FIG. 3 a drawing showing the results of simulating the relationship between the oscillation frequency and the amplitude of ions when a signal of a resonance frequency at which an octupole electric field having 4% of a ratio of strength with respect to a quadrupole electric field is superposed on a dodecapole electric field having −2% of a ratio of strength is applied to the end cap electrodes 11 and 12. As can be seen from FIG. 3, the influence of the octupole electric field similarly as the one described in FIG. 2 is dominant while the amplitude is small, and a deviation is observed in the direction where the resonance frequency is high (that is, in the direction to the right); however, when the amplitude becomes large to some extent, the influence of the dodecapole electric field causes a deviation in the direction where the resonance frequency decreases (that is, in the direction to the left). This behavior is shown by a thick dotted arrow in FIG. 3.

Figure 6:
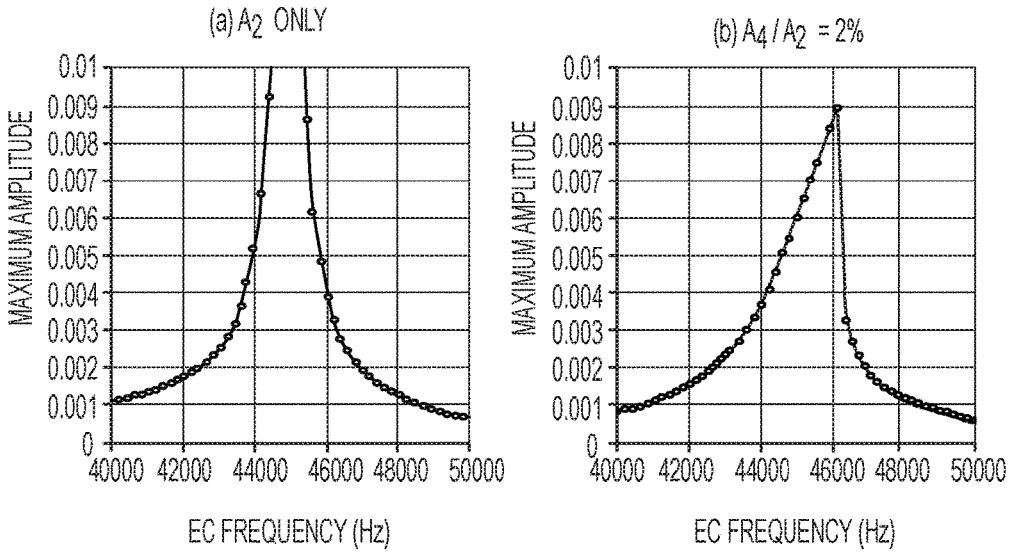
FIG. 6 is a drawing illustrating the simulation results of the resonance curve when the high-frequency electric field is only a quadrupole electric field and when an octupole electric field having 2% of a ratio of strength with respect to a quadrupole electric field is superposed.

The jumping phenomenon as shown in FIG. 5 at (c) has been known to occur in a nonlinear vibration as described above. FIG. 6 at (b) shows the result of calculating the resonance curve under the condition in which the octupole electric field having a ratio of strength of 2% with respect to the quadrupole electric field is superposed. As can be seen from FIG. 6 at (b), on the high frequency side, the slope of a peak is steep extending in an almost vertical manner. This can be conjectured to be due to the jumping phenomenon described above. When a conventional ion trap is used as a mass separator, the ion discharge from the ion trap by the steep slope on this high frequency side is rapidly carried out, and it has an effect of improving the mass resolution. FIG. 6 at (a) is a resonance curve in the case of only the quadrupole electric field, and when compared to this, the vibration amplitude of the peak top can be suppressed in FIG. 6 at (b). This means that the ability to confine ions is increasing, leading to the improvement in the ion capture efficiency.

On the other hand, the slope of the peak of the resonance curve shown in FIG. 6 at (b) on the low frequency side is quite gentle compared to the slope of the resonance curve shown in FIG. 6 at (a). This lowers the resolution of ion isolation on the low frequency side. That is, the slope of the resonance curve should be made as steep as possible on both the low and high frequency sides while suppressing the vibration amplitude of the peak of the resonance curve in order to achieve high resolution of ion isolation on both sides, the low frequency side and the high frequency side, while keeping the ion capture efficiency high.

As described above, simply superposing the octupole electric field on the quadrupole electric field results in a steep slope of the resonance curve peak on the high frequency side but a gentle slope on the low frequency side. On the contrary, it is expected from the results shown in FIG. 3 that superposing the octupole electric field on the quadrupole electric field and further superposing the dodecapole electric field, which has a reversed polarity as that of the octupole electric field, offsets the shift of the resonance curve peak.

The following three methods can be considered mainly as the methods of increasing the ratio of the multipole electric field superposed on the quadrupole electric field.

Figure 7:
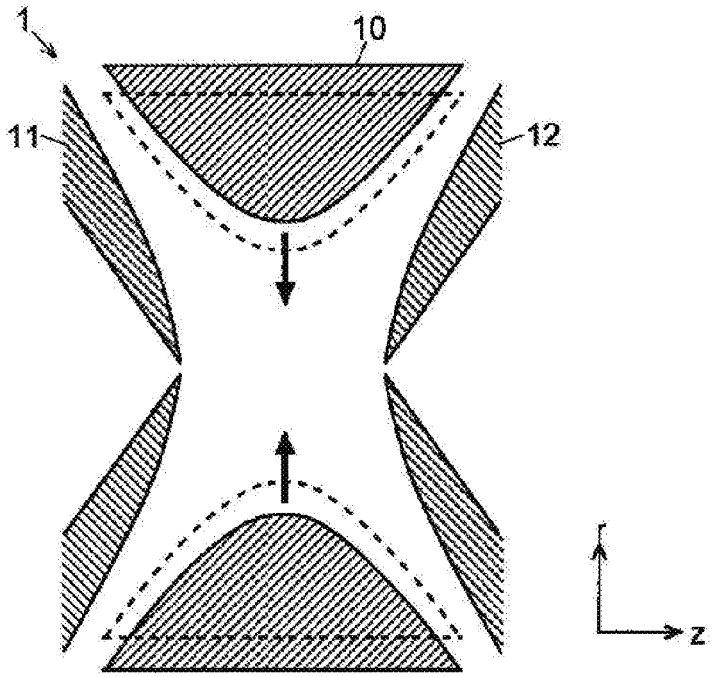
FIG. 7 is a drawing illustrating an example of the shape and arrangement of electrodes when the strengths of an octupole electric field and a dodecapole electric field superimposed on a quadrupole electric field are changed.

(1) As shown in FIG. 7, the inscribed radius $r_0$ is made small while the shape of the ring electrode 10 of the ion trap 1 is kept to be in an ideal state. For example, when the inscribed radius $r_0$ in an ideal state is 10 mm, setting this inscribed radius to 7 mm allows the generation of a multipole electric field having 4% in $A_4/A_2$ (the ratio of strength of the octupole electric field with respect to the strength of the quadrupole electric field) and −2.3% in $A_6/A_2$ (the ratio of strength of the dodecapole electric field with respect to the quadrupole electric field.

Figure 8:
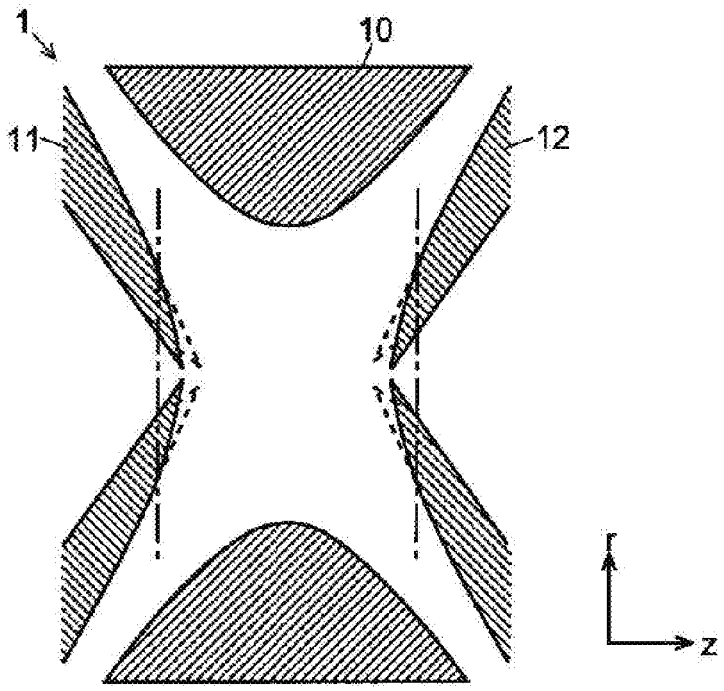
FIG. 8 is a drawing illustrating an example of the shape and arrangement of electrodes when the strengths of an octupole electric field and a dodecapole electric field superimposed on a quadrupole electric field are changed.

(2) As shown in FIG. 8, the surface shape of both end cap electrodes 11 and 12 surrounding z-axis is in substantially conical shape on the top side from the plane that is orthogonal to z-axis at a predetermined position on z-axis. By shifting the shape of the end cap electrodes 11 and 12 in this manner from the ideal state, the octupole electric field in which $A_4/A_2$ is positive and the dodecapole electric field in which $A_6/A_2$ is negative can be superposed on the quadrupole electric field.

Figure 9:
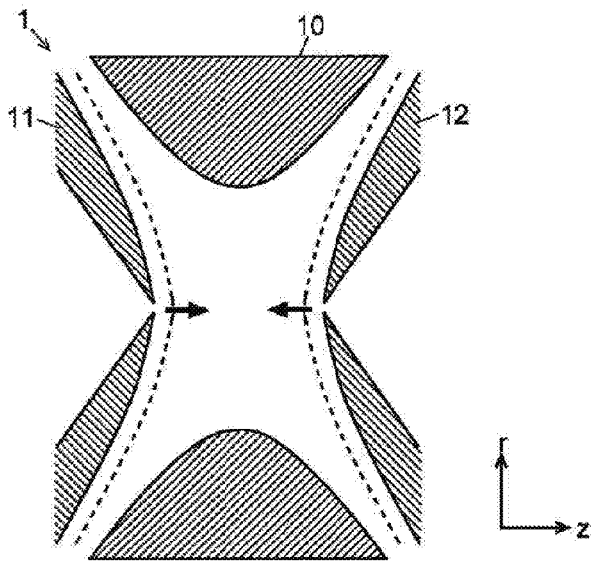
FIG. 9 is a drawing illustrating an example of the shape and arrangement of electrodes when the strengths of an octupole electric field and a dodecapole electric field superimposed on a quadrupole electric field are changed.

(3) As shown in FIG. 9, the shapes of both end cap electrodes 11 and 12 are shifted inwardly at the same distant each while maintaining an ideal shape. Thereby, it is possible to reduce the octupole electric field while keeping the dodecapole electric field to some extent.

The change of strength of the multipole electric field according to the shape and the arrangement of electrodes as described above and the change of the resonance curve according to that [change of strength] were confirmed by the simulations. In the simulations, the following six models of ion traps, A-F, were assumed. In either case, the inscribed radius $r_0$ of the ring electrode 10 was reduced from 10 mm, which is the ideal state, to 7 mm while maintaining the shape thereof. In addition, the opening aperture of the ion incident aperture 11*a* and the ion exit aperture 12*a* drilled in the center of the end cap electrodes 11 and 12 was 1.4 mm.

(A): The portions of both end cap electrodes 11 and 12 extended inwardly from the position of the inscribed radius of 4 mm were changed into a conical shape.

(B): The portions of both end cap electrodes 11 and 12 extended inwardly from the position of the inscribed radius of 1.25 mm were changed in to a conical shape.

(C): The positions of both end cap electrodes 11 and 12 were shifted 0.1 mm inwardly from the ideal state.

(D): The positions of both end cap electrodes 11 and 12 were shifted 0.2 mm inwardly from the ideal state.

(E): The positions of both end cap electrodes 11 and 12 were shifted 0.5 mm inwardly from the ideal state.

(F): The positions of both end cap electrodes 11 and 12 were shifted 0.6 mm inwardly from the ideal state.

Figure 10:
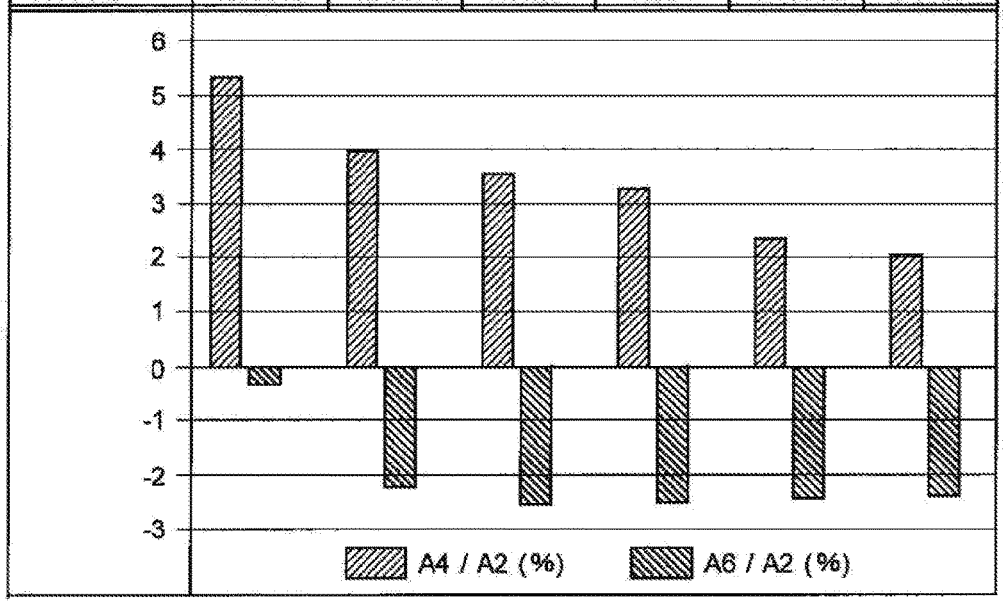
FIG. 10 is a drawing showing a ratio of strength of an octupole electric field and a dodecapole electric field with respect to a quadrupole electric field and the ratio of strength of an octupole electric field with respect to a dodecapole electric field in each model in which the shape and arrangement of electrodes have been changed.
Figure 11:
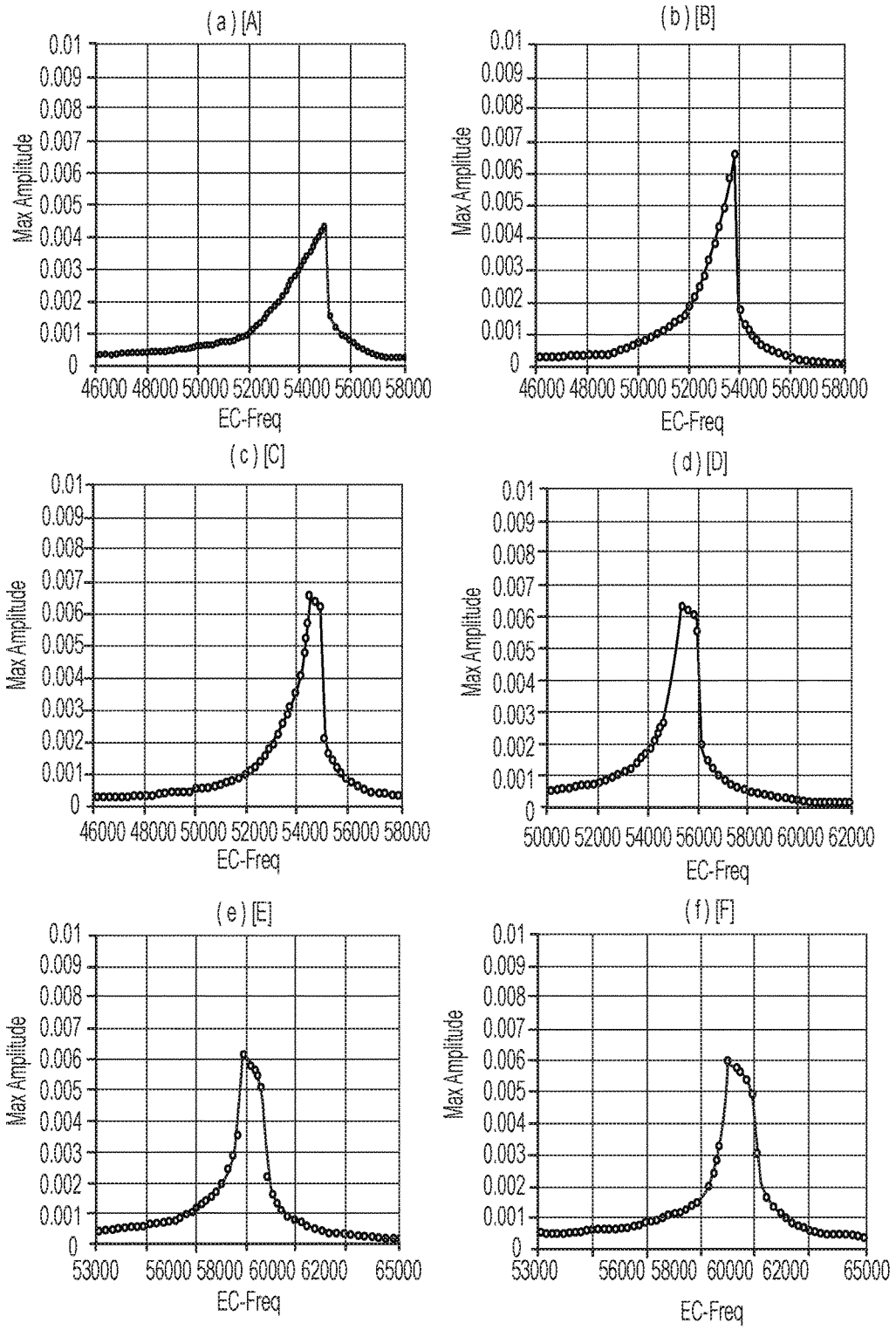
FIG. 11 is a drawing showing the simulation results of the resonance curve in each model shown in FIG. 10.

FIG. 10 shows the results after calculating the quadrupole electric field component, the octupole electric field component, and the dodecapole electric field component in the six models of ion traps described above and calculating the ratio of the strength of the octupole electric field component and the strength of the dodecapole electric field component with respect to the strength of the quadrupole electric field component. FIG. 11 shows the results of drawing the resonance curve of these six models of ion traps. As can be seen from FIG. 10, the ratio of the octupole electric field with respect to the quadrupole electric field ($A_4/A_2$) decreases in the order of from (A) to (F), and the dodecapole electric field component increases relatively.

When the octupole electric field component is dominant when compared to the octupole electric field component and the dodecapole electric field component, the peak of the resonance curve shows strong asymmetric as shown in FIG. 11. And the peak of the resonance curve as the octupole electric field component decreases and the dodecapole electric field component relatively increases is close to a symmetrical shape. This can be conjectured to be due to the effect of elimination of peak shift of the resonance curve by the dodecapole electric field.

Figure 12:
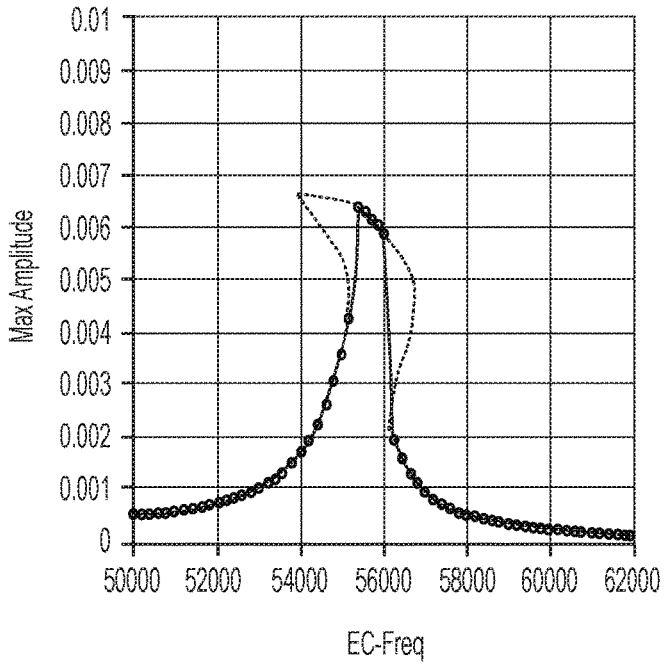
FIG. 12 is an explanatory drawing of a shape of the resonance curve in model (D) shown in FIG. 11.
Figure 13:
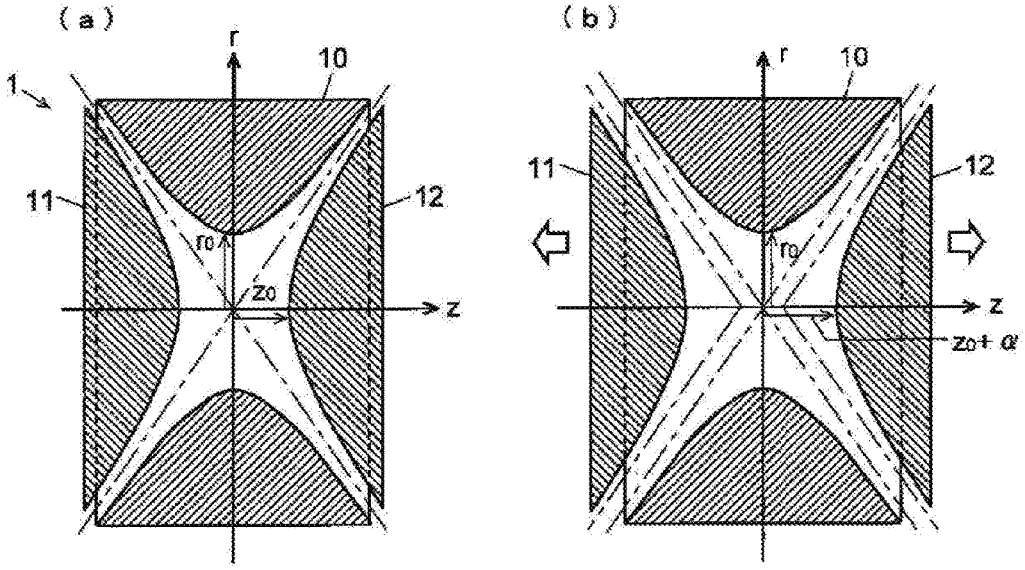
FIG. 13 at (a) is a cross sectional view illustrating a basic configuration of a three-dimensional quadrupole-type ion trap, which is a typical ion trap, and at (b) is a cross sectional view of an example of a configuration in which an ion trap is intentionally distorted from a theoretical shape.

The resonance curve shown in FIG. 11 at (d) has its slopes in between the peak in a shape that stands almost vertically, and it is presumed that a jumping phenomenon also occurred not only on the high frequency side but also on the low frequency side. This is considered to be due to the occurrence of the jumping phenomenon caused by the octupole electric field component on the high frequency side and the jumping phenomenon caused by the dodecapole electric field as shown in FIG. 12 on the low frequency side. If the slopes can be made to be close to vertical on both high and low frequency sides by the coexistence of the octupole electric field component and the dodecapole electric field component having the same size with their positive and negative polarity being in reverse, the performance of the ion isolation can be improved. Furthermore, the vibration amplitude of the peak can be suppressed, so it is possible to also realize high ion capture efficiency.

On the other hand, in the resonance curve as shown in FIG. 11 at (f), since the octupole electric field component decreases too much, the rounding of the edge of the peak on the high frequency side becomes slightly larger. In this state, the performance of ion isolation on the high frequency side tends to deteriorate. As such, it can be seen that the requirements of the ratio of the octupole electric field component and the dodecapole electric field component that can achieve edge-like slopes that are almost vertical for both the high frequency and low frequency in the peak of the resonance curve are limited.

To be specific, as can be seen from the results above, to fulfill the requirements described above, the absolute values of the ratio of the octupole electric field component with respect to the quadrupole electric field component ($A_4/A_2$) and the ratio of the dodecapole electric field component with respect to the quadrupole electric field component ($A_6/A_2$) should be equal to or greater than 0.02, and the absolute value of the ratio of the octupole electric field component with respect to the dodecapole electric field component ($A_4/A_6$) should be in the range of from 0.6 to 1.4. Of the six models described above, models C-F fulfilled these requirements. That is, the inscribed radius $r_0$ of the ring electrode 10 was reduced from 10 mm, which is an ideal state, to 7 mm while maintaining its shape, and the positions of both end cap electrodes 11 and 12 were shifted in the range of from 0.1 to 0.6 mm inwardly from their ideal state. Such configuration makes it possible to achieve sufficiently high ion isolation resolution while sufficiently maintaining high ion capture efficiency.

The example of embodiment described above employed a three-dimensional quadrupole-type ion trap as the ion trap; however, the present invention can also be applied to a linear-type ion trap that can capture ions by the same principle, and having the effects described above has been clarified.

EXPLANATION OF REFERENCES

1 . . . an ion trap
10 . . . a ring electrode
11, 12 . . . end cap electrodes
11*a* . . . an ion incident aperture
12*a* . . . an ion exit aperture
2 . . . an ion source
3 . . . an ion detector
4 . . . a power supply unit

What is claimed:

1. An ion trap design method for designing an ion trap for capturing ions in a space in which a quadrupole electric field and a multipole electric field of order higher than that of the quadrupole electric field surrounded by equal to or greater than three electrodes by the voltage applied to each of those electrodes and for carrying out ion isolation by allowing ions with a specific mass-to-charge ratio or a specific range of mass-to-charge ratio to remain while eliminating other ions from the ions captured, the method comprising:

determining a shape and an arrangement of the three or more electrodes so that the polarities of the ratio of strength of an octupole electric field with respect to the strength of a quadrupole electric field and the ratio of strength of a dodecapole electric field with respect to the strength of the quadrupole electric field are different from each other, the absolute values of the ratio of the strength of the octupole electric field with respect to the strength of the quadrupole electric field and the ratio of the strength of the dodecapole electric field with respect to the strength of the quadrupole electric field are equal to or greater than 0.02, and the absolute value of the ratio of the strength of the octupole electric field with respect to the strength of the dodecapole electric field is within the range of from 0.6 to 1.4.

2. The ion trap design method according to claim 1, wherein the ion trap is a three-dimensional quadrupole-type ion trap comprising one ring electrode and two end cap electrodes arranged so as to facing each other, in which the octupole electric field and the dodecapole electric field are superposed on the quadrupole electric field by reducing the inscribed radius of the ring electrode and shifting the two end cap electrodes in the direction close to the central point from the ideal state in which only the quadrupole electric field is formed in the ion trap.

3. An ion trap mass spectrometer, comprising:

an ion source for generating ions originating from a sample, an ion trap comprising equal to or greater than three electrodes for capturing ions in a space by forming a quadrupole electric field and a multipole electric field of order higher than that of the quadrupole electric field in a space surrounded by these electrodes by a voltage applied to these electrodes, and an ion detector for detecting ions discharged from the ion trap;

wherein the ion trap mass spectrometer is used for performing an ion isolation in which after the ions are captured by the ion trap, of those ions, the ions having a specific mass-to-charge ratio or included in a specific range of mass-to-charge ratio are allowed to remain while the other ions are eliminated, wherein the ion trap is configured to have a shape and an arrangement of the three or more electrodes determined so that the polarities of the ratio of strength of an octupole electric field with respect to the strength of a quadrupole electric field and the ratio of strength of a dodecapole electric field with respect to the strength of the quadrupole electric field are different from each other, the absolute values of the ratio of the strength of the octupole electric field with respect to the strength of the quadrupole electric field and the ratio of the strength of the dodecapole electric field with respect to the strength of the quadrupole electric field are equal to or greater than 0.02, and the absolute value of the ratio of strength of the octupole electric field with respect to the strength of the dodecapole electric field is within the range of from 0.6 to 1.4.

* * * * *